US006089962A

United States Patent [19]

Spinassé

[11] Patent Number: 6,089,962

[45] Date of Patent: Jul. 18, 2000

[54] MACHINE FOR POLISHING RAILWAY VEHICLE WHEEL AXLES

[75] Inventor: Jose Carlos Spinassé , Serra-E. Santo, Brazil

[73] Assignee: Companhia Vale Do Rio Doce, Minas Gerais, Brazil

[21] Appl. No.: 09/157,080

[22] Filed: Sep. 18, 1998

[30] Foreign Application Priority Data

Sep. 22, 1997 [BR] Brazil ..... 9704090

[51] Int. Cl.[7] ..... B24B 21/00

[52] U.S. Cl. ..... 451/296; 451/303; 451/304

[58] Field of Search ..... 451/296, 302, 451/303, 304, 49, 434, 51, 307, 297, 242, 243, 251, 246, 360, 397, 398, 399, 400; 157/13; 82/105, 104

[56] References Cited

U.S. PATENT DOCUMENTS 449,350 3/1891 Elder ..... 451/434

3,732,648 5/1973 Schaller ..... 451/242

4,635,405 1/1987 Stump ..... 451/307

5,741,174 4/1998 Kaiser, Jr. et al. ..... 451/307

*Primary Examiner*—Derris H. Banks

*Attorney, Agent, or Firm*—Helfgott & Karas, P.C.

[57] ABSTRACT

A machine for polishing railway vehicle wheel axles comprising a U-shaped basic structure with a cradle form, on the vertical double walls of which are arranged a pair of support rollers for the respective wheels of a railway axle. A driving assembly having a pair of support arms for abrasive belts is disposed on the intermediate horizontal wall of said cradle and said arms being selective and intermittently displaced from one side to the other between the gap defined by the vertical double walls and selective and vertically displaced upwards between the intermediate horizontal wall of the cradle. The axle to be milled is kept on a horizontal plan in view of the action of the wheels.

6 Claims, 2 Drawing Sheets

MACHINE FOR POLISHING RAILWAY VEHICLE WHEEL AXLES

DESCRIPTION OF THE INVENTION

The present invention refers to a machine for polishing railway vehicle wheel axles, and more specifically to an automated machine to be driven by a driving unit and hydraulically moved for promoting the polishing of almost all the extension of the wheel axle neck.

As is well known by those skilled in the art, the milling of locomotive wheel axles which are rough along the bearing neck and out of the pattern preset by the manufacturer is presently carried out on a horizontal lathe.

In spite of being broadly used, this method shows a number of drawbacks among which may be cited the long time and complexity for displacing and positioning the axle to be worked up at the machining center and the likelihood of individually performing that task.

The machining on a horizontal lathe requires the operator to displace the wheel from the locomotive car disassembling shop to the machining center or sector, such displacement being carried out with the help of stackers or equivalent conveyors.

Another inconvenience in this conventional milling treatment of wheel axles refers to the fact that besides the need of stackers for conveying the axle to be milled, it is required to provide an overhead crane for positioning the wheel axle by the horizontal lathe, what requires time and ability of the operator to perform this procedure.

Another inconvenience when carrying out this milling is the fact that it is required to assemble a special equipment by the horizontal lathe for milling the crankshaft.

A further inconvenience in this conventional technique is the fact that it is possible to mill the one by one the axle necks, what slows the process in view of the number of axles present in a locomotive.

OBJECTIVES OF THE INVENTION

Therefore, one object of this invention is to provide a machine for polishing railway vehicle wheel axles which allows for a fast and simple displacement and positioning operation of the axle to be machined at the machining center.

Another object of this invention is to provide a machine for polishing railway vehicle wheel axles which does not require the operator to displace the wheel from the locomotive car disassembling shop to the machining center or sector, thus eliminating the need to provide stackers or equivalent conveyors.

Another object of this invention is to provide a machine for polishing railway vehicle wheel axles which does not require the provision of an overhead crane for positioning the wheel axle by the horizontal lathe, thus minimizing the time for performing the procedure.

Another object of this invention is to provide a machine for polishing railway vehicle wheel axles which does not require the assembling of a special equipment by the horizontal lathe for milling the crankshaft.

SUMMARY OF THE INVENTION

These and other objects and advantages of this invention are accomplished by a machine for polishing railway vehicle wheel axles comprising a U-shaped basic structure with a cradle form, on the vertical double walls of which are arranged support rollers for the respective wheels of a railway axle. A driving assembly having a pair of support arms for abrasive belts is arranged on the intermediate horizontal wall of said cradle, said arms being selective and intermittently displaced from one side to the other side between the gap defined by the vertical double walls; and selective and vertically displaced upwards between the intermediate horizontal wall of the cradle and the respective axle of the wheel to be milled through hydraulic arms. The axle to be milled is kept on a horizontal plan in view of the action of the wheel bearing together with the support rolls.

BRIEF DESCRIPTION OF THE DRAWINGS

The present invention shall now be described with reference to the drawings which represent a preferred embodiment of the invention and wherein.

DETAILED DESCRIPTION OF THE INVENTION

Figure 1:
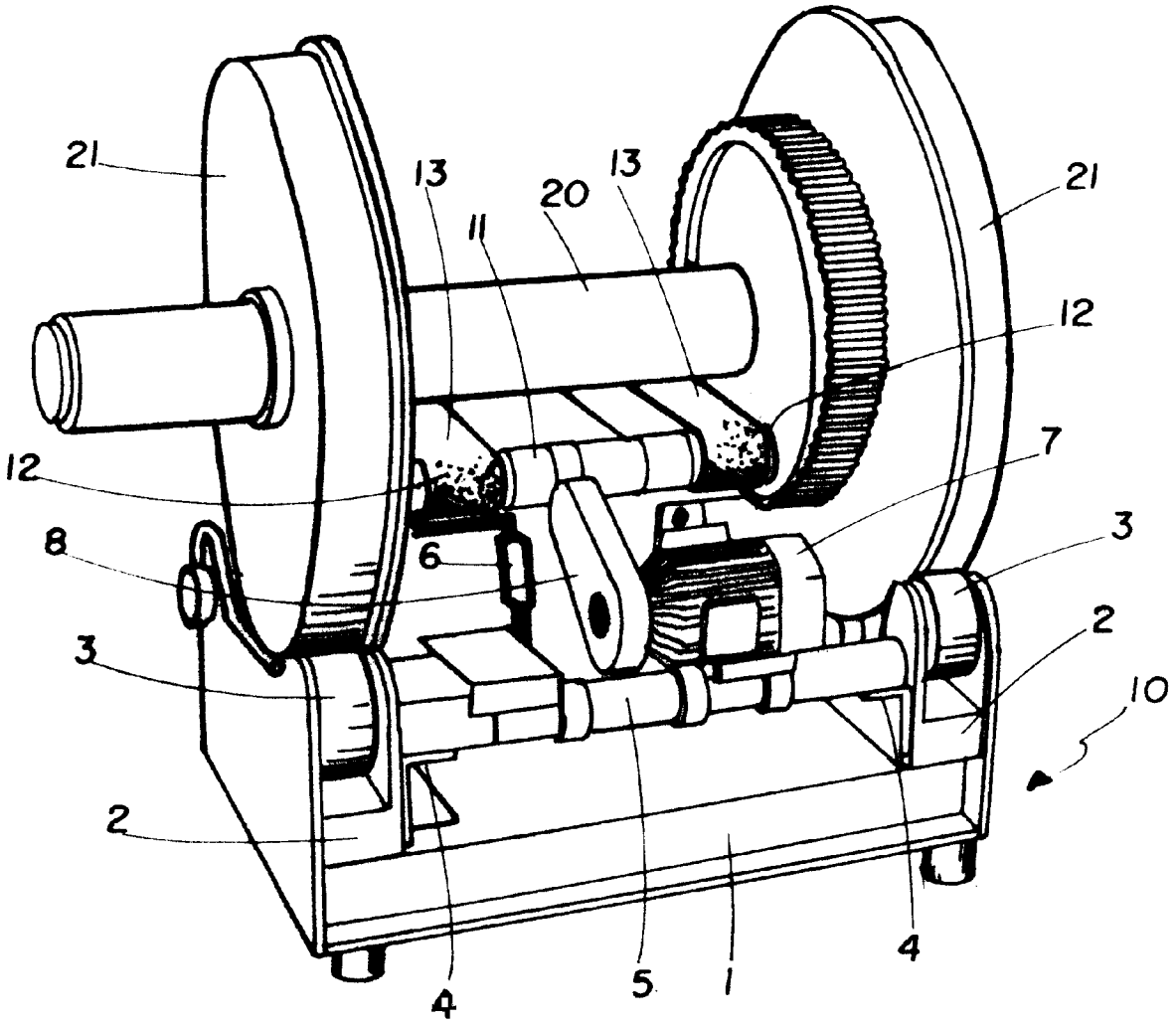
FIG. 1 is a perspective view of the machine according to the invention supporting a wheel which axle is to be milled, the abrasive belt being inoperative.
Figure 2:
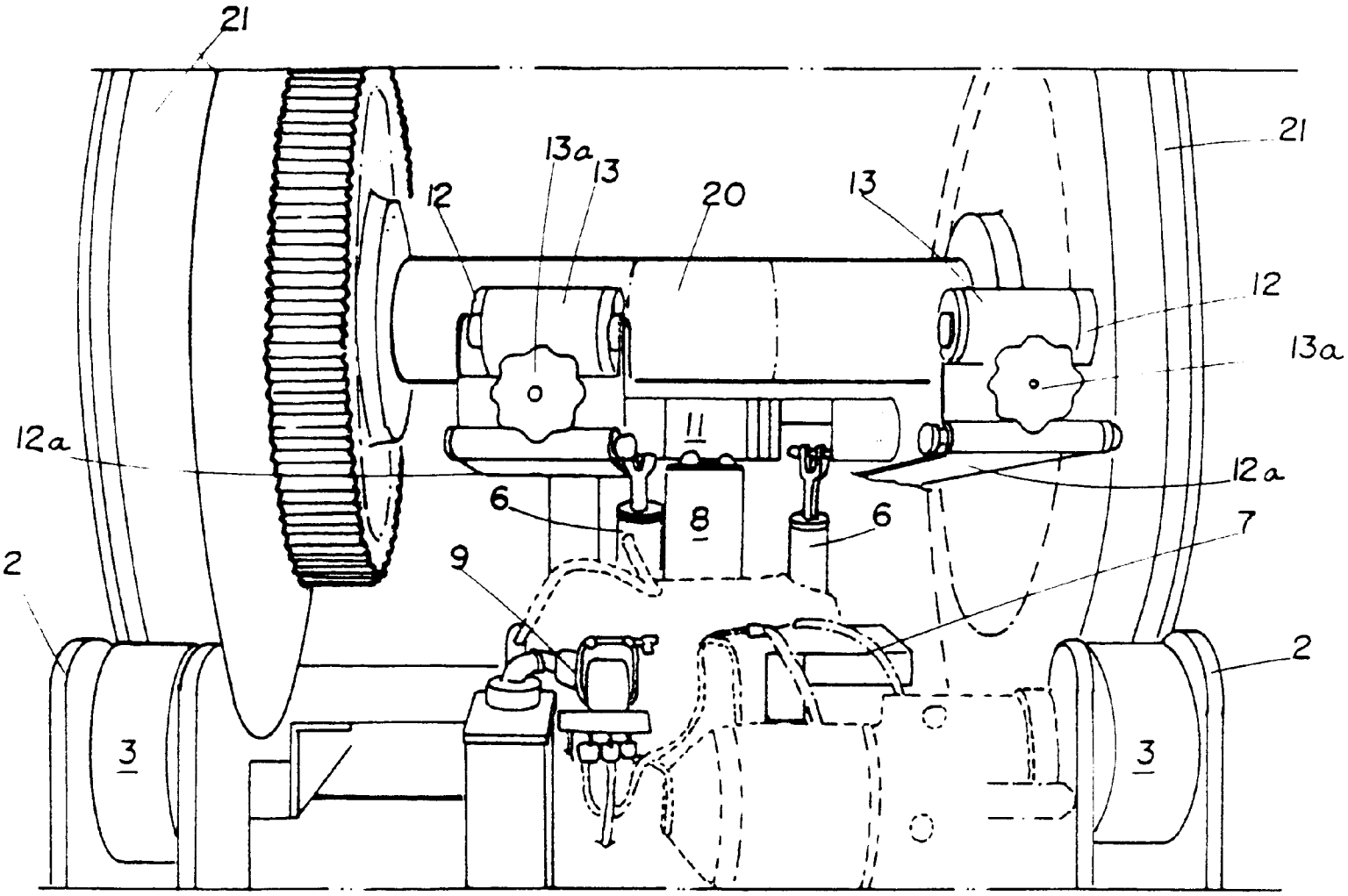
FIG. 2 shows an expanded detailed perspective view of the machine as shown in FIG. 1 wherein the wheel axle is being polished by the abrasive belts.

According to the Figures, the machine for polishing railway vehicle wheel axles object of this invention comprises a U-shaped basic structure 10 with a cradle form, having a lower and intermediate horizontal wall 1 and double vertical end walls 2. Between these end walls a pair of support rollers 3 is arranged on which are supported the respective wheels 21 of a railway axle 20.

Into the inner face of said vertical double walls 2, inverted L-profiles 4 are disposed on which the corresponding transverse axle ends 5 are attached. On the transverse axle ends 5 the hydraulic arms 6, electric motors 7, driving assembly 8 and valve assembly 9 are arranged by attachment thereto into suitable bearings.

The driving assembly 8 interconnects the electric motor axle 7 with an upper transverse driving rod 11 which is kept between a pair of transverse axles 12 assembled for supporting two endless abrasive belts 13.

The endless abrasive belts 13 are rotatory actuated by the driving assembly 8. The endless abrasive belts 13 are lateral and oscillatory displaced by hydraulic arms 6, and are provided with vertical regulation upwards or downwards by bolts and regulating handles 13a provided between the transverse axles 12 and a suspending plate 12a incorporated underneath axle 12 and driving rod 11.

What is claimed is:

1. A machine for polishing a railway vehicle wheel axle, said machine comprising:

U-shaped basic structure with a cradle form, having a plurality of vertical double walls attached to a respective one of a pair of support rollers, said support rollers support a plurality of respective wheels of a railway axle; and a driving assembly having a pair of support arms for abrasive belts is attached to an intermediate horizontal wall of the cradle, said pair of support arms is selectively and intermittently displaced from one side to a second side between a gap defined by the plurality of vertical double walls and selectively and vertically displaced upwards between the intermediate horizontal wall of the cradle and the respective wheels of the railway axle.

2. A machine according to claim 1, wherein the axle to be milled is kept on a horizontal plan by action of a plurality of wheels bearing together with the support rolls.

3. A machine according to claim 1, wherein inverted L-profiles are disposed into an inner face of said vertical double walls, and on which plurality of corresponding transverse axle ends are attached.

4. A machine according to claim 1, further comprising a plurality of electric motors, a valve assembly, and a plurality of hydraulic arms, wherein said plurality of hydraulic arms, saids plurality of electric motors, said driving assembly and said valve assembly are attached by bearings to a plurality of corresponding transverse axle ends attached to said plurality of vertical double walls by inverted L-profiles.

5. A machine according to claim 1, wherein the mentioned driving assembly interconnects an electric motor axle with an upper transverse driving rod which is kept between a pair of transverse axles assembled for supporting the two endless abrasive belts.

6. A machine according to claim 1, wherein the endless abrasive belts are lateral and oscillatory displaced by said hydraulic arms, and are provided with vertical regulation upwards or downwards by bolts and regulating handles provided between a plurality of transverse axles and a suspending plate incorporated underneath said plurality of axles and driving rod.

* * * * *